US009719476B2

(12) United States Patent
Rauznitz

(10) Patent No.: US 9,719,476 B2
(45) Date of Patent: Aug. 1, 2017

(54) B-LCCR INJECTOR PILOT VALVE ORIFICE, ARMATURE AND PLUNGER GUIDE ARRANGEMENT

(71) Applicant: Cummins Inc., Columbus, IN (US)

(72) Inventor: Tamas Rauznitz, Columbus, IN (US)

(73) Assignee: Cummins Inc., Columbus, IN (US)

( * ) Notice: Subject to any disclaimer, the term of this patent is extended or adjusted under 35 U.S.C. 154(b) by 250 days.

(21) Appl. No.: 14/330,657

(22) Filed: Jul. 14, 2014

(65) Prior Publication Data

US 2016/0010606 A1 Jan. 14, 2016

(51) Int. Cl.

| | |
|---|---|
| ***F02M 41/16*** | (2006.01) |
| ***F02M 63/00*** | (2006.01) |
| ***B05B 9/04*** | (2006.01) |
| ***F02M 51/06*** | (2006.01) |
| ***F02M 47/02*** | (2006.01) |

(52) U.S. Cl.

CPC ..... *F02M 63/0036* (2013.01); *B05B 9/0403* (2013.01); *F02M 47/027* (2013.01); *F02M 51/061* (2013.01); *F02M 63/0071* (2013.01); *F02M 2200/304* (2013.01)

(58) Field of Classification Search

CPC ..... F02M 63/0036; F02M 63/0071; F02M 47/027; F02M 51/061; F02M 2200/304; B05B 9/0403

USPC ..... 239/96, 124, 127, 585.1, 585.3, 585.4, 239/900; 251/129.15, 129.21

See application file for complete search history.

(56) References Cited

U.S. PATENT DOCUMENTS

| | | | | |
|---|---|---|---|---|
| 4,494,701 | A | 1/1985 | Hensley et al. | |
| 4,946,103 | A | 8/1990 | Ganser | |
| 5,154,350 | A * | 10/1992 | Ausiello | F02M 63/0036 239/96 |
| 5,626,325 | A | 5/1997 | Buchanan et al. | |
| 6,161,774 | A | 12/2000 | Ricco | |
| 6,499,669 | B2 | 12/2002 | Ganser | |
| 6,663,014 | B1 | 12/2003 | Depayva et al. | |

(Continued)

FOREIGN PATENT DOCUMENTS

| | | |
|---|---|---|
| WO | 2014/210148 | 12/2014 |
| WO | 2015-020940 | 2/2015 |

OTHER PUBLICATIONS

International Search Report and Written Opinion dated Sep. 30, 2015 in International Application No. PCT/US2015/040263.

*Primary Examiner* — Steven J Ganey
(74) *Attorney, Agent, or Firm* — Faegre Baker Daniels

(57) ABSTRACT

A fuel injector device for injecting fuel into a combustion chamber of an internal combustion engine is provided in which the fuel injector includes a body having an upper chamber and a lower chamber, an annular shoulder between the upper and lower chambers, an armature assembly disposed in the upper chamber, and a pilot valve seat having an inlet orifice disposed in the lower chamber and an outlet orifice disposed in the upper chamber. The pilot valve seat has a shaft extending between the outlet and inlet orifice and an angled shoulder between the outlet and inlet orifice. The angle shoulder of the shaft prevents fuel flow around the shaft between the upper and lower chambers. The armature assembly is configured to move to an upward position and to a downward position, the shaft also being disposed within the armature assembly to guide the armature assembly between the upward and downward positions.

25 Claims, 3 Drawing Sheets

(56) References Cited

U.S. PATENT DOCUMENTS

| | | | | |
|---|---|---|---|---|
| 6,837,221 | B2 | 1/2005 | Crofts et al. | |
| 7,156,368 | B2 | 1/2007 | Lucas et al. | |
| 7,458,529 | B2 * | 12/2008 | Ricco | F02M 47/027 239/585.3 |
| 8,128,005 | B2 * | 3/2012 | Magel | F02M 47/027 239/96 |
| 8,291,707 | B2 | 10/2012 | Williams et al. | |

* cited by examiner

B-LCCR INJECTOR PILOT VALVE ORIFICE, ARMATURE AND PLUNGER GUIDE ARRANGEMENT

FIELD OF THE DISCLOSURE

The present disclosure generally relates to common-rail fuel injector devices for injecting fuel into a combustion chamber of an internal combustion engine, and more particularly to an injector pilot valve orifice, armature and plunger guide arrangement.

BACKGROUND OF THE DISCLOSURE

The introduction of fuel into the cylinders of an internal combustion engine is most commonly achieved using fuel injectors. A commonly used injector is a closed-nozzle injector which includes a nozzle assembly having a spring-biased needle valve element positioned adjacent the injector nozzle for allowing fuel to be injected into the cylinder of an internal combustion engine. The needle valve element also functions to provide a deliberate, abrupt end to fuel injection. The needle valve is positioned in the injector body and although biased downward by a spring force, a hydraulic force acting on the needle valve primarily holds the needle valve in the closed position. When an actuated force exceeds the biasing hydraulic force or causes a change in the magnitude of the hydraulic force, the needle valve element moves to allow fuel to pass through the injector nozzle, thus marking the beginning of the fuel injection event.

Internal combustion engine designers have increasingly come to realize that substantially improved fuel supply systems are required in order to meet the ever increasing governmental and regulatory requirements of emissions abatement and increased fuel economy. As such one aspect of fuel supply systems that has been the focus of designers is the need to produce alternative fuel injector designs that utilize fewer component parts and therefore contribute to reduced manufacturing costs. If such goals are to be attained fuel injector designs must evolve to yield reliable high quality fuel injectors that perform effectively but which are also less expensive to produce.

For instance, manufacturers have implemented extra high pressure injection systems, also known as XPI, where the pressures can reach 2600 bar. Such high injection pressures create smaller fuel droplets and higher injection velocity to promote more complete burning of the fuel, which increases power and fuel economy. In addition, pollution is reduced because the high thermal efficiencies result in low emissions of hydrocarbons (HC) and carbon monoxide (CO). By injecting required amounts of fuel in a shorter time frame, a high pressure system can accommodate multiple injection events during each combustion cycle. As a result, the engine control software can tailor combustion for particular conditions.

The use of very high injection pressures, however, requires conventional fuel injectors to operate with correspondingly high force levels. In general, to move the needle valve into an open position and cause the injection of fuel, solenoids and their corresponding stator assemblies must act against a preload force that seals the high pressure fuel in the fuel injector. For instance, in one type of fuel injector design, an injector body with a lower chamber filled with high pressure fuel is employed to bias the needle valve in the closed position, and the solenoid opens a plunger valve in the upper chamber in order to expose the lower chamber to a low pressure drain. When the fuel drains from the lower chamber, the pressure in the lower chamber drops and is no longer able to keep the needle valve in the closed position. In order to open the plunger valve, the solenoid must act against the preload force that seals high pressure in the lower chamber. Thus, all internal components in such fuel injectors must work together to provide large forces due to the high pressure which exists in the fuel injector.

Additionally, as injection pressures increase, greater forces must be applied to the injector components of the injector body to achieve the required sealing at the component interfaces/joints. Moreover, injectors often include internal component configurations which are well suited to achieving desired high pressure performance characteristics but do so at high design and manufacturing costs. Consequently, there is a need for a lower cost common rail fuel injector having an improved pilot valve inlet and outlet orifice arrangement and a unique armature and plunger guide arrangement.

SUMMARY OF THE DISCLOSURE

The various aspects of the present disclosure may be achieved by providing a common-rail fuel injector which uses an improved pilot valve inlet and outlet orifice arrangement as well as an improved armature and plunger guide arrangement. In one embodiment of the disclosure, a fuel injector is provided comprising a body having an upper chamber and a lower chamber and an armature assembly disposed in the upper chamber, and a pilot valve seat having an inlet orifice disposed in the lower chamber and an outlet orifice disposed in the upper chamber. According to one aspect of this embodiment, the fuel injector further includes a solenoid disposed adjacent the armature assembly and having an active state which causes the armature assembly to move to an upward position, thereby permitting movement of a check ball out of sealing engagement with the outlet orifice, and an inactive state which permits the armature assembly to move to a downward position, thereby causing the check ball to move into sealing engagement with the outlet orifice. In a variant of this aspect, the fuel injector further includes a needle valve reciprocally moveable in the body. In this variant, when the check ball is moved out of sealing engagement with the outlet orifice, the needle valve moves upwardly, thereby causing fuel to be delivered from the injector. In another aspect, the body includes an annular shoulder between the upper chamber and the lower chamber, the pilot valve seat has an inlet end with the inlet opening, an outlet end with the outlet opening, and a shaft extending between the inlet end and the outlet end in sealing engagement with the shoulder. In a variant of this aspect, the shaft has a machined outer surface and the armature assembly has a central bore which receives the shaft such that the armature assembly is guided by the machined outer surface of the shaft as the armature assembly moves between the upward position and the downward position. In another variant, the inlet end of the pilot valve seat has a first diameter and the outlet end of the pilot valve seat has a second diameter which is smaller than the first diameter. In another variant, the pilot valve seat further includes an angled shoulder between the inlet end and the shaft, the angled shoulder forming a seal with the annular shoulder of the body, thereby preventing fuel flow around the shaft between the upper chamber and the lower chamber. In another aspect of this embodiment, the pilot valve seat is press fit and pressure energized within the body. In yet another aspect, the pilot valve seat further includes a central passage providing flow communication between the inlet orifice and the outlet orifice. In a variant of this aspect, the outlet orifice is positioned directly under the check ball and integrated within an upper end of the pilot valve seat and the central passage may extend longitudinally towards a lower end of the pilot valve seat. In a variant of this variant, the inlet orifice is offset drilled and integrated within a lower end of the pilot valve seat. The inlet orifice allows fuel to flow from the lower chamber into an area above the needle valve, up the central passage toward the outlet orifice and immediately below the check ball. In a variant of this aspect, the fuel injector includes a shim disposed in the upper chamber such that the stroke gap between the stator assembly and the armature assembly is adjustable using the shim.

According to another embodiment of the present disclosure, a fuel injector is provided comprising a body having an upper chamber, a lower chamber and an annular shoulder between the upper chamber and the lower chamber, an armature assembly disposed in the upper chamber, and a pilot valve seat having a first end disposed in the lower chamber, a second end disposed in the upper chamber, a shaft extending between the first end and the second end, and an angled shoulder between the first end and the shaft in sealing engagement with the annular shoulder of the body, thereby preventing fuel flow around the shaft between the upper chamber and the lower chamber. In one aspect of this embodiment, the fuel injector further includes a solenoid disposed adjacent the armature assembly and having an active state which causes the armature assembly to move to an upward position, thereby permitting fuel flow through the pilot valve seat, and an inactive state which permits the armature assembly to move to a downward position, thereby preventing fuel flow through the pilot valve seat. In a variant of this aspect, the fuel injector further includes a needle valve that responds to movement of the armature assembly to the upward position by delivering fuel from the injector and movement of the armature assembly to the downward position by preventing delivery of fuel from the injector. In another aspect of this embodiment, the angled shoulder of the pilot valve seat forms a pressure energized annular fluid seal with the annular shoulder of the body in response to engagement by high pressure fuel. In a variant of this aspect, the pilot valve seat is positioned in unfastened abutment against the annular shoulder of the body such that a differential fuel pressure acts upwardly on the pilot valve seat to secure the pilot valve seat in place and to assist in creating the annular fluid seal between the pilot valve seat and the annular shoulder of the body.

In yet another embodiment of the present disclosure, a fuel injector is provided comprising a body having an upper chamber, an armature assembly disposed in the upper chamber, the armature assembly being configured to move to an upward position and to a downward position, and a pilot valve seat having a shaft disposed within the armature assembly to guide the armature assembly between the upward position and the downward position. In one aspect of this embodiment, the pilot valve seat includes an inlet orifice disposed in a lower chamber of the body and an outlet orifice disposed in the upper chamber. In a variant of this aspect, the body includes an annular shoulder between the upper chamber and the lower chamber, the pilot valve seat having an inlet end with the inlet opening, an outlet end with the outlet opening, the shaft extending between the inlet end and the outlet end in sealing engagement with the shoulder. In another aspect, the shaft has a machined outer surface, the armature assembly having a central bore which receives the shaft such that the armature assembly is guided by the machined outer surface of the shaft as the armature assembly moves between the upward position and the downward position.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION OF EMBODIMENTS

The embodiments disclosed herein are not intended to be exhaustive or to limit the disclosure to the precise forms disclosed in the following detailed description. Rather, the embodiments were chosen and described so that others skilled in the art may utilize their teachings.

Figure 1:
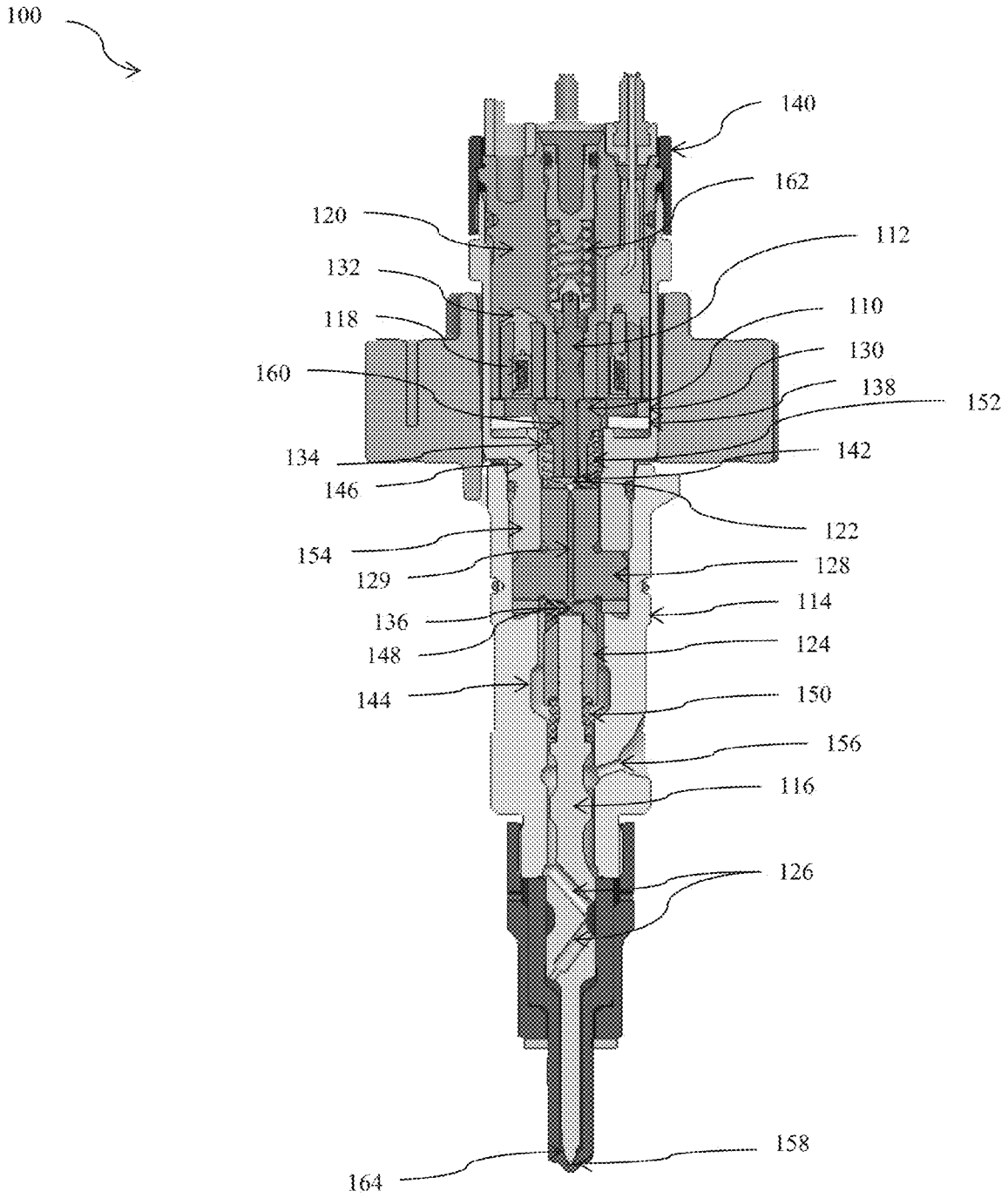
FIG 1. PRIOR ART
FIG. 1 is a cross-sectional view of a prior art mid-range XPI fuel injector.

FIG. 1 is a cross-sectional view of a prior art mid-range XPI fuel injector 100. Fuel injector 100 generally includes an armature assembly 110, a plunger 112, an injector body 114, and a needle valve 116. Injector body 114 includes upper chamber 146 and lower chamber 144 for receiving a plurality of components therein. The disclosed embodiment provides an inner cavity within lower chamber 144 for receiving needle valve 116, a needle sleeve 124, a needle spring 150, a needle seal 136, a pilot valve seat 128, and a check ball 122. The disclosed embodiment further provides an inner cavity within upper chamber 146 for receiving armature assembly 110, plunger 112, an armature spring 152, a spring disk 138, and a stator assembly 120. Upper chamber 146 is a low pressure environment of fuel injector 100 relative to the high pressure environment below check ball 122.

Stator assembly 120 is fixed within the upper chamber 146 and retained in place by retainer 140. In the disclosed embodiment the bottom surface of stator assembly 120 is a precision calibrated distance away from armature assembly 110. The other end of armature assembly 110 is supported via abutting engagement with check ball retainer 142.

The middle section of plunger 112 includes an angled shoulder disposed on the upper surface of armature assembly 110 thereby creating a reciprocal connection such that when armature assembly 110 moves in the upward direction plunger 112 moves therewith. Armature spring 152 is biased against the flanged elements of armature assembly 110 and biases armature assembly 110 and plunger 112 in an upwardly direction. Armature assembly 110 resides within an inner cavity of upper chamber 146 and further includes central bore 160 for receiving the shaft of plunger 112 there through. The outer diameter of the shaft of plunger 112 is sized and configured to provide a close or match fit in relation to the inner diameter of central bore 160 while still permitting sliding movement of plunger 112. This close/match fit inhibits fuel leakage between the outer diameter of the shaft of plunger 112 and the inner diameter of central bore 160 while permitting relative sliding movement.

Injector body 114 also includes lower chamber 144 which further includes an inner cavity that houses needle valve 116, needle sleeve 124, needle spring 150, needle seal 136, pilot valve seat 128, and check ball 122. Needle spring 150 biases needle valve 116 in a downward direction and applies a closing spring force to needle valve 116 thereby preventing fuel from exiting through injector orifice 158 when solenoid 132 is inactive. Needle seal 136 includes control orifices 148 integrated within the seal. Needle seal 136 is disposed above needle valve 116 and includes end points that terminate adjacent needle sleeve 114. The surface of the lower end of pilot valve seat 128 abuts the top surface of needle seal 136, while the surface of the upper end of pilot valve seat 128 is disposed immediately below armature spring 152. Pilot valve seat 128 further includes valve seat central passage 129. Valve seat central passage 129 extends longitudinally from the lower end of pilot valve seat 128 towards the upper end.

Lower chamber 144 further includes fuel entry orifice 156 which is configured to supply fuel to the inner cavity of lower chamber 144. The inner cavity as well as cross drilled fluid channels 126 facilitate fuel flow throughout lower chamber 144. The fuel supply pressure may be within a pressure range of approximately 500-2600 bar. Control orifices 148 function to route fuel flow up valve seat central passage 129. When coils 118 are de-energized and solenoid 132 is in an inactive state, check ball 122 is in sealing engagement with pilot valve seat 128. Check ball 122 also functions as a moveable valve member and thus moves out of sealing engagement with pilot valve seat 128. When check ball 122 is in sealing engagement with pilot valve seat 128, fuel from lower chamber 144 is blocked from entering upper chamber 146. When fuel is supplied to lower chamber 144 and check ball 122 is in sealing engagement with pilot valve seat 128 the inner cavity of lower chamber 144 becomes a highly pressurized volume. When check ball 122 functions as a moveable valve member and moves out of sealing engagement with pilot valve seat 128, high pressure fuel flows up valve seat central passage 129 through pilot valve seat 128 and into the inner cavity of upper chamber 146.

Injector 100 utilizes needle valve 116 in a normally closed position. When needle valve 116 is in its normally closed position, coils 118 are de-energized and solenoid 132 is in an inactive state. Additionally, plunger return spring 162 exerts a spring force downwardly such that plunger 112 and armature assembly 110 exert a downward force on check ball retainer 142 which thus secures and retains check ball 122 into sealing engagement with pilot valve seat 128. Pressurized fuel is continuously supplied to the inner cavity of lower chamber 144.

When coils 118 are de-energized fuel from lower chamber 144 is blocked from entering upper chamber 146 thus the inner cavity of lower chamber 144 becomes highly pressurized. Due to the fuel supply pressure acting downwardly on needle valve 116, a large downward hydraulic force pushes needle valve 116 in the downward direction. Needle spring 150 also resides in the inner cavity of lower chamber 144 and is compressed about the upper end of needle valve 116 such that when solenoid 132 is inactive, high pressure fuel as well as a downward spring force on needle valve 116 both act to secure needle valve 116 against needle valve seat 164. Securing needle valve 116 against needle valve seat 164 prevents high pressure fuel from exiting injector 100 via injector orifice 158.

For a fuel injection, injector 100 requires an intermediate pressure or force loss, such as depressurizing the pressurized control volume by creating a low pressure drain flow from the control volume. The beginning of an injection event is initiated by energizing coils 118 with an electric current. As coils 118 of solenoid 132 are energized the solenoid acts as a type of electromagnet which then causes armature assembly 110 to rapidly move upwardly in magnetic attraction with solenoid 132. Because plunger 112 is disposed atop armature assembly 110, the strength of the solenoid's magnetic force acting on armature assembly 110 further causes plunger 112 to move upwardly against the downward biasing force of plunger return spring 162. When coils 118 are energized solenoid 132 is in an active state thereby causing armature assembly 110 and plunger 112 to move to an upward position, permitting movement of check ball 122 out of sealing engagement with pilot valve seat 128. During an injection event check ball 122 functions as a moveable valve member and, when it moves out of sealing engagement with pilot valve seat 128, high pressure fuel residing in valve seat central passage 129 flows through pilot valve seat 128 into the inner cavity of upper chamber 146.

The flow of high pressure fuel from the inner cavity of lower chamber 144 to the inner cavity of upper chamber 146 creates a pressure differential. The pressure difference between the high fuel supply pressure in lower chamber 144 and the low pressure in upper chamber 146 results in significant hydraulic force acting in a direction to lift needle valve 116 and allow an injection event. Needle valve 116 is therefore lifted off needle valve seat 164 allowing fuel to be injected into the engine combustion chamber via injector orifice 158 which may contain various spray outlet arrangements.

The fuel injection event is ended by de-energizing coils 118, which results in solenoid 132 being inactive and thus causing the downward force of plunger return spring 162 to force plunger 112 to exert a downward force on armature assembly 110. The downward force exerted on armature assembly 110 via plunger return spring 162 forces check ball 122 back into sealing engagement with pilot valve seat 128. When check ball 122 is in sealing engagement with pilot valve seat 128, high pressure fuel from lower chamber 144 is once again blocked from entering the inner cavity of upper chamber 146. As fuel is continuously supplied to lower chamber 144 and with check ball 122 in sealing engagement with pilot valve seat 128, the inner cavity of lower chamber 144 again becomes highly pressurized. The seal created by check ball 122 as well as the high pressure fuel supplied to the inner cavity of lower chamber 144 both combine to produce a highly pressurized control volume in lower chamber 144. Due to the fuel supply pressure acting downwardly on needle valve 116, a large downward hydraulic force pushes needle valve 116 back to the downward direction. Needle spring 150 further applies a downward biasing spring force in order to expedite seating needle valve 116 against needle valve seat 164, thus preventing high pressure fuel from exiting injector 100 and ending the injection event.

Figure 2:
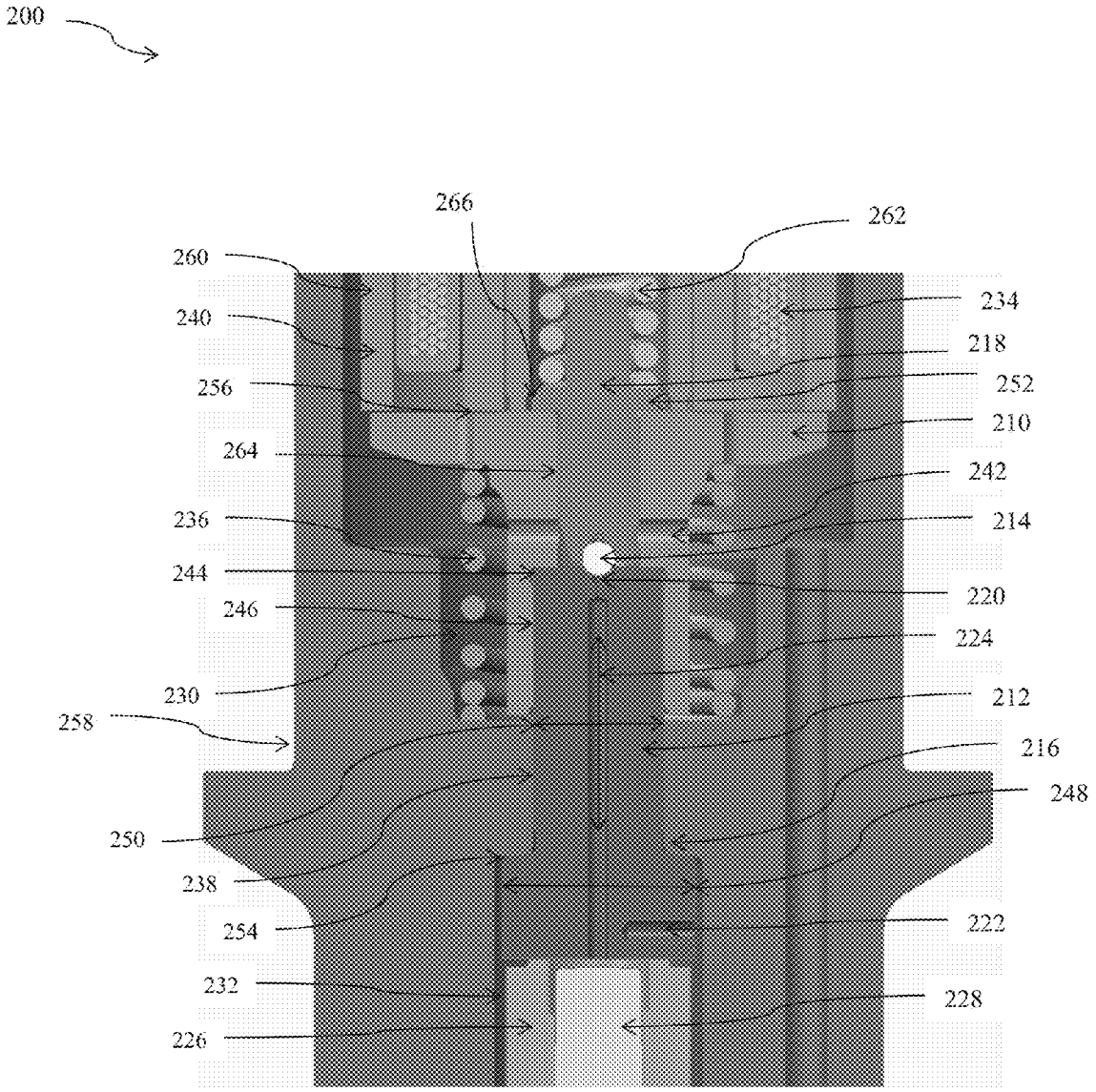
FIG. 2 is an enlarged cross-sectional view of an exemplary embodiment of a common rail fuel injector according to the present disclosure.

FIG. 2 provides an exemplary embodiment of the present disclosure designed to overcome one or more shortcomings of conventional injectors and/or offer features noted herein below. Fuel injector 200 generally includes an injector body 258, an armature assembly 210, a plunger 218, a pilot valve seat 212, a check ball 214, a needle sleeve 226, and a needle valve 228. Pilot valve seat 212 further includes an inlet end with an inlet orifice 222, an outlet end with an outlet orifice 220, a central passage 224, and a pilot valve shaft 238 including a machined outer surface and extending between the inlet end and the outlet end. The injector body 258 includes an upper chamber 230 and a lower chamber 232 for receiving a plurality of components therein as well as an annular shoulder 216 between upper chamber 230 and lower chamber 232. The disclosed embodiment provides an inner cavity within upper chamber 230 for receiving a stator assembly 260, a solenoid 240, a coil 234, outlet orifice 220, an armature spring 236, and a plunger return spring 262. The disclosed embodiment further includes an inner cavity within lower chamber 232 for receiving the inlet end of pilot valve seat 212, needle valve 228 and needle sleeve 226. Upper chamber 230 is a low pressure environment of fuel injector 200 relative to the high pressure environment below pilot valve seat 212.

Figure 3:
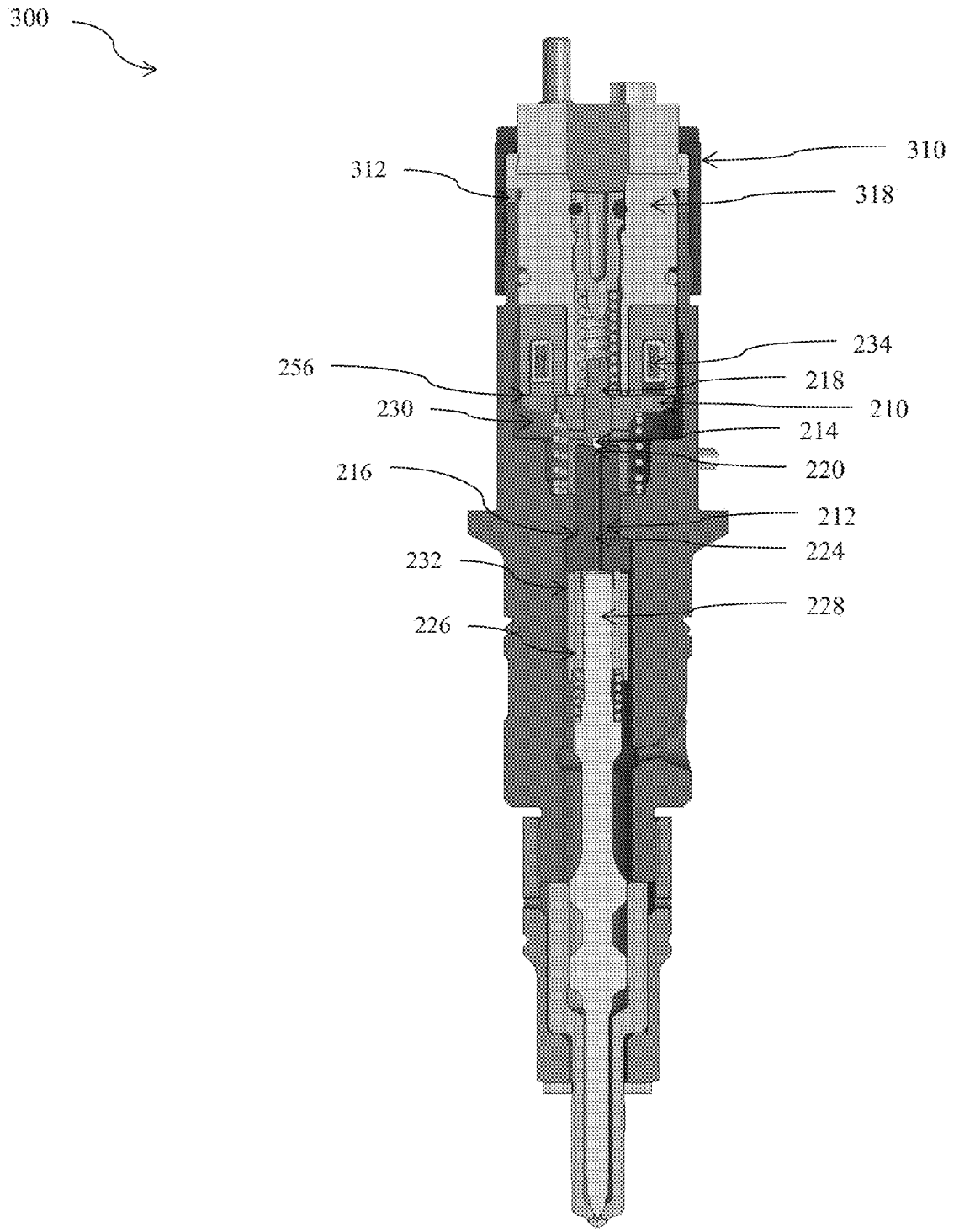
FIG. 3 is a cross-sectional view of another embodiment of a common rail fuel injector including a hard shimmed stroke setting feature according to the present disclosure.

Stator assembly 260 is fixed within upper chamber 230 and is retained in place by retainer 310 as provided in FIG. 3. In the disclosed embodiment of FIG. 2 the bottom surface of stator assembly 260 is a precision calibrated distance from one end of armature assembly 210. The distance between stator assembly 260 and armature assembly 210 is indicated by stroke gap 256 and is described in further detail in the disclosed embodiment of FIG. 3. Stator assembly 260 further includes solenoid 240 disposed directly above armature assembly 210, wherein solenoid 240 has an active state which permits armature assembly 210 to move to an upward position and an inactive state which permits armature assembly 210 to move to a downward position. The other end of armature assembly 210 includes a pilot valve central bore 246 which receives pilot valve shaft 238 such that armature assembly 210 is guided by the machined outer surface of pilot valve shaft 238 as armature assembly 210 moves between the upward position and the downward position. Armature assembly 210 resides within the inner cavity of upper chamber 230 and further includes plunger central bore 264 for receiving plunger 218 there through. Plunger 218 includes a shaft portion disposed within plunger central bore 264 of armature assembly 210 and an angled shoulder 252 disposed on the upper surface of armature assembly 210 thereby creating a reciprocal connection such that when armature assembly 210 moves in the upward direction plunger 218 moves therewith. The outer diameter of the shaft of plunger 218 is sized and configured to provide a close or match fit in relation to the inner diameter of plunger central bore 264 while still permitting sliding movement of plunger 218. This close/match fit inhibits fuel leakage between the outer diameter of the shaft of plunger 218 and the inner diameter of plunger central bore 264 while permitting relative sliding movement. Armature assembly 210 further includes flanged elements disposed directly below solenoid 240 and coils 234 as well as armature fuel drain orifice 242 which provides a drain path for fuel to enter upper chamber 230 during an injection event. Armature spring 236 is biased against the flanged elements of armature assembly 210 and biases armature assembly 236 and plunger 218 in an upwardly direction.

Referring again to FIG. 2, plunger return spring 262 resides within the inner cavity of upper chamber 230, is disposed directly above plunger angled shoulder 252, and provides a downward spring force such that plunger 218 exerts a downward force on check ball 214. The downward spring force provided by plunger return spring 262 against plunger 218 secures and retains check ball 214 into sealing engagement with outlet orifice 220. Outlet orifice 220 is positioned directly under check ball 214 and is integrated within the outlet end of pilot valve seat 212 and central passage 224. Central passage 224 extends longitudinally between the inlet end and outlet end of pilot valve seat 212 and provides flow communication between inlet orifice 222 and outlet orifice 220. Pilot valve seat 212 further includes an inlet end with a first diameter 248 and an outlet end with a second diameter 250 wherein the second diameter is smaller than the first diameter. Pilot valve seat 212 further includes an angled shoulder 254 between the inlet end and pilot valve shaft 238 such that angled shoulder 254 forms a seal with injector body annular shoulder 216 thereby inhibiting fuel flow around pilot valve shaft 238 between upper chamber 230 and lower chamber 232. Pilot valve seat 212 is press fit and pressure energized within injector body such that pilot valve angled shoulder 254 is in sealing engagement with injector body annular shoulder 216. Inlet orifice 222 is offset drilled and integrated within the inlet end of pilot valve seat 212 thereby causing fuel to flow from lower chamber 232 into an area above needle valve 228, up central passage 224 toward outlet orifice 220, and immediately below check ball 214.

When coils 234 are de-energized and solenoid 240 is in an inactive state, the biasing spring force of plunger return spring 262 exerts a downward force on plunger 218 such that check ball 214 is in sealing engagement with outlet orifice 220. Check ball 214 also functions as a moveable valve member and thus moves out of sealing engagement with outlet orifice 220. When check ball 224 is in scaling engagement with outlet orifice 220, fuel from lower chamber 232 is blocked from entering upper chamber 230. When fuel is supplied to lower chamber 232 and check ball 214 is in sealing engagement with outlet orifice 220 the inner cavity of lower chamber 232 becomes a highly pressurized volume. When coils 234 are energized and solenoid 240 is in an active state, check ball 214 functions as a moveable valve member and moves out of sealing engagement with outlet orifice 220. When check ball 214 moves out of sealing engagement with outlet orifice 220 high pressure fuel flows through pilot valve seat 212 via inlet orifice 222. After high pressure fuel enters pilot valve seat 212 via inlet orifice 222, it travels up central passage 224, through outlet orifice 220, through armature fuel drain orifice 242, and into the inner cavity of upper chamber 230.

Fuel injector 200 further includes needle valve 228 and needle sleeve 226 which are fixed within the inner cavity of lower chamber 232. Needle valve 228 is reciprocally moveable within lower chamber 232 such that when check ball 214 is moved out of sealing engagement with outlet orifice 220, needle valve 228 moves upwardly, thereby causing fuel to be delivered from fuel injector 200.

For fuel injection to occur, injector 200 requires an intermediate pressure or force loss, such as depressurizing the pressurized control volume of lower chamber 232 by creating a low pressure drain flow from the control volume. The beginning of an injection event is initiated by energizing coils 234 with an electric current. As coils 234 of solenoid 240 are energized the solenoid acts as a type of electromagnet which then causes armature assembly 210 to rapidly move upward in magnetic attraction with solenoid 240. Because plunger 218 is disposed atop armature assembly 210, the strength of the solenoid's magnetic force acting on armature assembly 210 further causes plunger 218 to move upwardly against the downward biasing force of plunger return spring 262. When coils 234 are energized, solenoid 240 is in an active state thereby causing armature assembly 210 and plunger 218 to move to an upward position, thus permitting movement of check ball 214 out of sealing engagement with outlet orifice 220. During an injection event check ball 214 functions as a moveable valve member such that when check ball 214 moves out of sealing engagement with outlet orifice 220, high pressure fuel residing in valve seat central passage 224 flows through outlet orifice 220, through armature fuel drain orifice 242, and into the inner cavity of upper chamber 230. The flow of high pressure fuel from the inner cavity of lower chamber 232 to the inner cavity of upper chamber 230 creates a pressure differential. The pressure difference between the high fuel supply pressure in lower chamber 232 and the low pressure in upper chamber 230 results in significant hydraulic force acting in a direction to lift needle valve 228 and allow an injection event.

The fuel injection event is ended by de-energizing coils 234, which results in solenoid 240 being inactive and thus causing the downward force of plunger return spring 262 to force plunger 218 to exert a downward force on armature assembly 210. Likewise, the downward force exerted on plunger 218 via plunger return spring 262 forces check ball 214 back into sealing engagement with outlet orifice 220. When check ball 214 is in sealing engagement with outlet orifice 220, high pressure fuel from lower chamber 232 is once again blocked from entering the inner cavity of upper chamber 230. As fuel is continuously supplied to lower chamber 232, and with check ball 214 back in sealing engagement with outlet orifice 220, the inner cavity of lower chamber 232 again becomes highly pressurized.

In contrast to fuel injector 100, fuel injector 200 includes an armature assembly 210 that is mounted on, and supported for reciprocating motion on pilot valve seat 212 such that plunger 218 is supported for reciprocating motion on armature assembly 210. In this way, pilot valve seat 212 directly supports and guides armature assembly 210 and indirectly supports plunger 218. In fuel injector 100 stator assembly 120 provides at least partial support for plunger 112, whereas in fuel injector 200 a clearance gap 266 exists between plunger 218 and stator assembly 260 such that plunger 218 is only directly supported by armature assembly 210 which in turn is supported by pilot valve seat 212. Moreover, in fuel injector 200 pilot valve seat 212 is arranged in injector body 258 such that angled shoulder 254 of pilot valve seat 212 forms a pressure energized annular fluid seal with injector body annular shoulder 216 in response to engagement by high pressure fuel. Pilot valve seat 212 is therefore positioned in unfastened abutment against injector body annular shoulder 216 such that differential fuel pressure acts upwardly on pilot valve seat 212 to secure it in place and to assist in creating the annular fluid seal. In prior art designs such as fuel injector 100, pilot valve seat 128 is held in place against the upwardly acting fuel pressure by threaded retainer 154 to injector body 114, whereas in fuel injector 200, there is no threaded connection between injector body 258 and pilot valve seat 212. Lastly, in prior art designs such as fuel injector 100, check ball 122 was secured by check ball retainer 142 while needle seal 136 and control orifice 148 caused fuel from lower chamber 144 to flow up central passage 129. In fuel injector 200, needle seal 136, control orifice 148, and check ball retainer 142 have been eliminated and replaced with an improved and streamlined design in which inlet orifice 222 is off-set drilled and integrated within pilot valve seat 212, while check ball 214 is disposed directly below and secured by plunger 218. Fuel injector 200 thus includes internal component configurations which achieve high pressure injector performance characteristics with fewer components and with less expensive design and manufacturing costs.

FIG. 3 is a cross-sectional view of fuel injector 300 which includes a hard shimmed stroke setting feature according to the present disclosure. Fuel injector 300 is a variant of fuel injector 200 and generally includes a stator assembly retainer 310, a stroke shim 312, a stator assembly 318, an armature assembly 210, and an upper chamber 230. Stator assembly 318 is disposed in upper chamber 230 directly above armature assembly 210 such that a stroke gap 256 exists between stator assembly 318 and armature assembly 210. Stator assembly 318 is set in location relative to armature assembly 210 to achieve a desired stroke and is then secured in place by stator retainer 310. Fuel injector 300 further includes stroke shim 312 disposed in the upper chamber 230 such that stroke gap 256 between stator assembly 318 and armature assembly is adjustable using stroke shim 312. A plurality of different shims 312 may be used to provide different stroke gaps 256.

What is claimed is:

1. A fuel injector, comprising:
a body having an upper chamber and a lower chamber;
an armature assembly disposed in the upper chamber; and
a pilot valve seat partially disposed within the armature assembly and having an inlet orifice disposed in the lower chamber and an outlet orifice disposed in the upper chamber.

2. The fuel injector of claim 1, further including a solenoid disposed adjacent the armature assembly and having an active state which causes the armature assembly to move to an upward position, thereby permitting movement of a check ball out of sealing engagement with the outlet orifice, and an inactive state which permits the armature assembly to move to a downward position, thereby causing the check ball to move into sealing engagement with the outlet orifice.

3. The fuel injector of claim 2, further including a needle valve reciprocally moveable in the body; wherein when the check ball is moved out of sealing engagement with the outlet orifice, the needle valve moves upwardly, thereby causing fuel to be delivered from the injector.

4. The fuel injector of claim 1, wherein the body includes an annular shoulder between the upper chamber and the lower chamber, the pilot valve seat having an inlet end with the inlet orifice, an outlet end with the outlet orifice, and a shaft extending between the inlet end and the outlet end in sealing engagement with the shoulder.

5. The fuel injector of claim 4, wherein the shaft of the pilot valve seat has a machined outer surface, the armature assembly having a central bore which receives the shaft such that the armature assembly is guided by the machined outer surface of the shaft as the armature assembly moves between the upward position and the downward position.

6. The fuel injector of claim 4, wherein the inlet end of the pilot valve seat has a first diameter and the outlet end of the pilot valve seat has a second diameter which is smaller than the first diameter.

7. The fuel injector of claim 4, wherein the pilot valve seat further includes an angled shoulder between the inlet end and the shaft, the angled shoulder forming a seal with the annular shoulder of the body, thereby preventing fuel flow around the shaft between the upper chamber and the lower chamber.

8. The fuel injector of claim 1, wherein the pilot valve seat is press fit and pressure energized within the body.

9. The fuel injector of claim 1, wherein the pilot valve seat further includes a central passage providing flow communication between the inlet orifice and the outlet orifice.

10. The fuel injector of claim 9, wherein the outlet orifice is positioned directly under a check ball and is integrated within an upper end of the pilot valve seat and the central passage extending longitudinally towards a lower end of the pilot valve seat.

11. The fuel injector of claim 10, wherein the inlet orifice is offset drilled and integrated within the lower end of the pilot valve seat, the inlet orifice allowing fuel to flow from the lower chamber into an area above a needle valve, up the central passage toward the outlet orifice and immediately below the check ball.

12. The fuel injector of claim 1, further including a shim disposed in the upper chamber such that the stroke gap between a stator assembly and the armature assembly is adjustable using the shim.

13. A fuel injector, comprising:

a body having an upper chamber, a lower chamber and an annular shoulder between the upper chamber and the lower chamber;

an armature assembly disposed in the upper chamber; and a pilot valve seat having a first end disposed in the lower chamber, a second end disposed in the upper chamber, a shaft extending between the first end and the second end, and an angled shoulder between the first end and the shaft in sealing engagement with the annular shoulder of the body, thereby preventing fuel flow around the shaft between the upper chamber and the lower chamber.

14. The fuel injector of claim 13, further including a solenoid disposed adjacent the armature assembly and having an active state which causes the armature assembly to move to an upward position, thereby permitting fuel flow through the pilot valve seat, and an inactive state which permits the armature assembly to move to a downward position, thereby preventing fuel flow through the pilot valve seat.

15. The fuel injector of claim 14, further including a needle valve that responds to movement of the armature assembly to the upward position by delivering fuel from the injector and movement of the armature assembly to the downward position by preventing delivery of fuel from the injector.

16. The fuel injector of claim 13, wherein the angled shoulder of the pilot valve seat forms a pressure energized annular fluid seal with the annular shoulder of the body in response to engagement by high pressure fuel.

17. The fuel injector of claim 16, wherein the pilot valve seat is positioned in unfastened abutment against the annular shoulder of the body such that a differential fuel pressure acts upwardly on the pilot valve seat to secure the pilot valve seat in place and to assist in creating the annular fluid seal between the pilot valve seat and the annular shoulder of the body.

18. The fuel injector of claim 13, wherein the shaft is in sealing engagement with the annular shoulder of the body.

19. A fuel injector, comprising:

a body having an upper chamber;

an armature assembly disposed in the upper chamber, the armature assembly being configured to move to an upward position and to a downward position; and a pilot valve seat having a shaft disposed within the armature assembly to guide the armature assembly between the upward position and the downward position.

20. The fuel injector of claim 19, wherein the pilot valve seat includes an inlet orifice disposed in a lower chamber of the body and an outlet orifice disposed in the upper chamber.

21. The fuel injector of claim 20, wherein the body includes an annular shoulder between the upper chamber and the lower chamber, the pilot valve seat having an inlet end with the inlet orifice, an outlet end with the outlet orifice, the shaft extending between the inlet end and the outlet end in sealing engagement with the shoulder.

22. The fuel injector of claim 19, wherein the shaft has a machined outer surface, the armature assembly having a central bore which receives the shaft such that the armature assembly is guided by the machined outer surface of the shaft as the armature assembly moves between the upward position and the downward position.

23. The fuel injector of claim 19, wherein the armature assembly includes a fuel drain orifice such that fuel flows into the upper chamber when the armature assembly moves to an upward position.

24. The fuel injector of claim 19, wherein the pilot valve seat further comprising an inlet orifice disposed in the lower chamber and an outlet orifice disposed in the upper chamber.

25. A fuel injector, comprising:

a body having an upper chamber and a lower chamber, the body including an annular shoulder between the upper chamber and the lower chamber;

an armature assembly disposed in the upper chamber;

a pilot valve seat having an inlet orifice disposed in the lower chamber and an outlet orifice disposed in the upper chamber, the pilot valve seat having an inlet end with the inlet orifice, an outlet end with the outlet orifice, wherein the inlet end of the pilot valve seat has a first diameter and the outlet end of the pilot valve seat has a second diameter which is smaller than the first diameter; and a shaft extending between the inlet end and the outlet end in sealing engagement with the shoulder.

* * * * *